United States Patent [19]

Kaneki et al.

[11] Patent Number: 4,725,196

[45] Date of Patent: Feb. 16, 1988

[54] SINGLE-SHAFT MULTI-STAGE CENTRIFUGAL COMPRESSOR

[75] Inventors: Tadashi Kaneki, Tsuchiura; Kazuo Takeda; Haruo Miura, both of Ibaraki, all of Japan

[73] Assignee: Hitachi, Ltd., Tokyo, Japan

[21] Appl. No.: 25,972

[22] Filed: Mar. 16, 1987

[30] Foreign Application Priority Data

Sep. 19, 1986 [JP] Japan ..... 61-219496
Sep. 19, 1986 [JP] Japan ..... 61-219510

[51] Int. Cl.[4] ..... F01D 11/00; F01D 3/02

[52] U.S. Cl. ..... 415/98; 415/100; 415/199.1; 415/199.2; 415/112

[58] Field of Search ..... 415/110, 111, 112, 113, 415/101, 102, 103, 100, 99, 98, 199.1, 199.2, 199.3, 199.6

[56] References Cited

FOREIGN PATENT DOCUMENTS

| | | | |
|---|---|---|---|
| 1032100 | 6/1958 | Fed. Rep. of Germany | 415/100 |
| 1001193 | 3/1946 | France | 415/199.2 |
| 0162388 | 9/1984 | Japan | 415/199.1 |
| 0200089 | 11/1984 | Japan | 415/199.1 |

*Primary Examiner*—Robert E. Garrett
*Assistant Examiner*—Therese M. Newholm
*Attorney, Agent, or Firm*—Antonelli, Terry & Wands

[57] ABSTRACT

A single-shaft multi-stage centrifugal compressor has a multiplicity of impellers for compressing a main gas and an impeller for compressing an intermediate suction gas which are carried by the same impeller shaft. The suction pressure of the impeller constituting the final stage for the compression of the main gas is maintained higher than the suction pressure of the impeller for compressing the intermediate suction gas. With this arrangement, a part of the main gas of a pressure slightly higher than the intermediate suction gas is introduced into the shaft seals, and the shaft seals and drainers are protected from any corrosive and toxic components which may be contained by the intermediate suction gas.

6 Claims, 9 Drawing Figures

SINGLE-SHAFT MULTI-STAGE CENTRIFUGAL COMPRESSOR

BACKGROUND OF THE INVENTION

The present invention relates to a single-shaft centrifugal compressor which is used as a gas compressor in various industrial plants such as petroleum refining plants, petrochemical plants and fertilizer synthesizing plants, as well as for the purpose of transporting natural gas in natural gas transporting pipeline. More particularly, the invention is concerned with a single-shaft multi-stage centrifugal compressor having an intermediate suction line and improved in such a manner as to protect shaft seals and other parts of the compressor from any corrosive or toxic component which may be contained by the gas (referred to as "intermediate suction gas", hereinafter) introduced through the intermediate suction line.

In general, a single-shaft multi-stage centrifugal compressor has a plurality of impellers carried by a shaft provided in a casing. The shaft is provided at its both ends with shaft seals.

The shaft seals are supplied not only with a seal oil but also with a part of the gas discharged from the compressor as a seal gas flow for the purpose of preventing the seal oil from coming into the compressor. Thus, the seal gas is a mixture of the intermediate suction gas (gas introduced from the recycle line) and the gas from the main gas line.

The seal gas and the seal oil after the use are separated from each other by a drainer and are discharged to the outside.

In another known sealing method, in order to positively form a seal gas flow, a clean buffer gas (seal gas) having a required sealing pressure is directly supplied from an external supply to the shaft seals by a suitable pressure-differential control.

The detail of the single-shaft multi-stage compressor is disclosed, for example, in an article which is entitled "The Use of Centrifugal Compressors in Ammonia Production Plants" which is a technical report of QUADERNI PIGNONE 9.

The above-described compressor which employs the sealing gas composed of the intermediate suction gas and the gas from the main line inevitably suffers from the following problem. Namely, in this type of compressor, part of the mixed gas as the seal gas is allowed to flow into the shaft seals and the drainer due to balance of pressures. Usually, the intermediate suction gas collected from a chemical process contains corrosive components such as carbonate. As the result, the shaft seals and the drainer are corroded and, therefore, cannot stand a long use.

On the other hand, the sealing method which relies upon the external supply of buffer gas results in a raised installation and running costs due to the necessity for a separate source for supplying the pressurized buffer gas.

SUMMARY OF THE INVENTION

Accordingly, an object of the present invention is to provide a single-shaft multi-stage centrifugal compressor having an extended life by virtue of protection of the shaft seals and the drainer from corrosive components and toxic components.

Another object of the present invention is to provide a single-shaft multi-stage centrifugal compressor which is improved so as to reduce the installation and running costs.

To these ends, according to the present invention, there is provided a single-shaft multi-stage centrifugal compressor for compressing and discharging a mixture of a main gas and an intermediate suction gas, comprising: a casing; an impeller shaft rotatably mounted in said casing; a multiplicity of impellers carried by the impeller shaft; and shaft seals on both axial ends of the impeller shaft, wherein an impeller constituting a final stage for compression of the main gas and an impeller for compressing the intermediate suction gas are arranged in a back-to-back relation, a suction pressure of said impeller constituting the final stage is maintained at a level higher than a suction pressure for an intermediate gas suction line, and a gas supply line is provided for introducing a sealing gas to said shaft seals from a region of the compressor where a pressure of a main gas line is higher than the suction pressure of said intermediate suction gas line.

The above and other objects, features and advantages of the present invention will become clear from the following description of embodiments when the same is read in conjunction with the accompanying drawings.

DETAILED DESCRIPTION OF THE EMBODIMENTS

A single-shaft multi-stage centrifugal compressor in accordance with an embodiment of the present invention will be described hereinunder with reference to the drawings.

Figure 1:
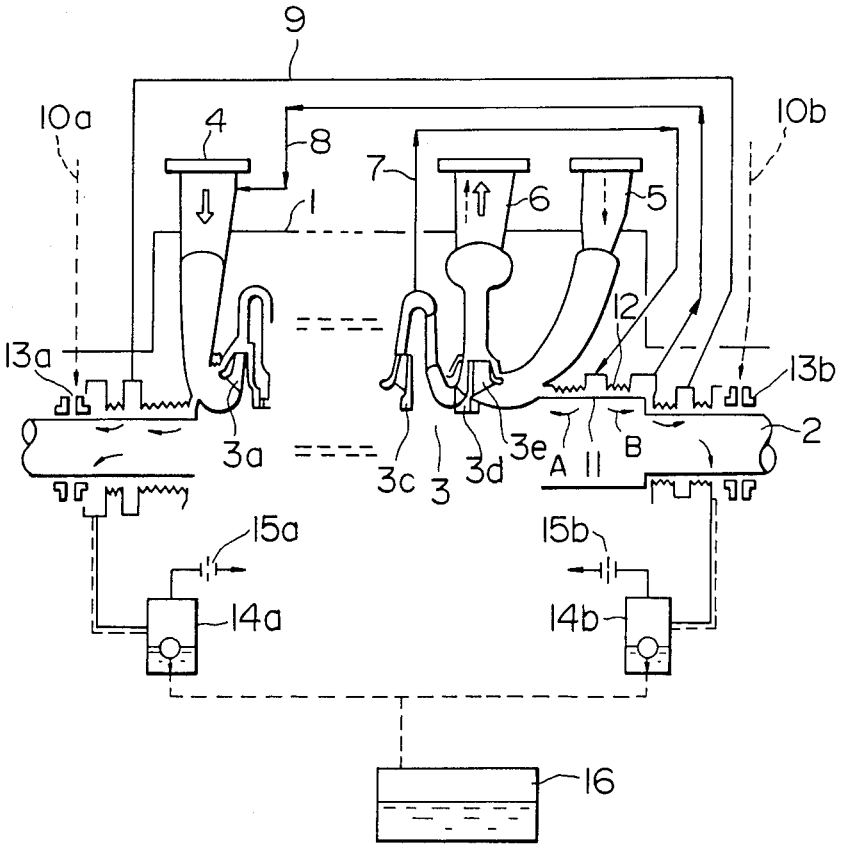
FIGS. 1 and 2 are schematic views showing the structure of a single-shaft multi-stage centrifugal compressor in accordance with an embodiment of the present invention.
Figure 2:
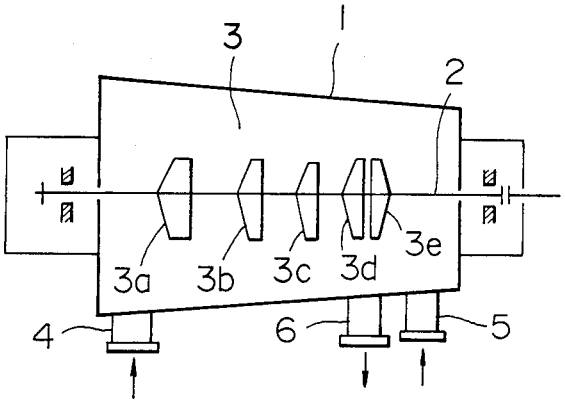

Referring first to FIGS. 1 and 2 which schematically show the whole of the single-shaft multi-stage centrifugal compressor of the present invention, the compressor has a casing 1 and an impeller shaft 2 which is rotatably mounted in the casing 1 and carries a multiplicity of impellers 3. In the illustrated embodiment, there are five impellers 3*a* to 3*e* constituting five compression stages. The impeller shaft 2 is adapted to be rotated at a high speed by a power source (not shown). The compressor has a main gas suction port 4 through which a gas from a main gas line is introduced into the impeller 3*a* of the first stage, and an intermediate gas suction port 5 through which an intermediate suction gas such as a mixture of hydrogen gas and nitrogen gas is introduced into the compression stage formed by the impeller 3e. A reference numeral 6 designates a discharge port through which the mixture gas, which is composed of the main gas from the final stage impeller 3d for compression of the main gas and the intermediate suction gas from the impeller 3d, is discharged from the casing. The impeller 3d of the final stage on the main gas line side and the impeller 3e on the intermediate gas line (recycle line) side are arranged in a back-to-back relation as will be explained later. The compressor also has a seal gas supply line 7 which is provided to supply a thrust balance piston 11 with a part of the main gas extracted from the upstream side of the impeller 3d of the final compression stage for the main gas, i.e., from the discharge side of the third-stage impeller 3c in the illustrated case. The compressor further has a seal balance line 8 through which the mixed gas, which has leaked through the gap between the thrust balance piston 11 and a balance labyrinth 12, is returned to the main gas suction port 4. A reference numeral 9 designates a thrust balance line. Numerals 10a and 10b designate seal oil supply lines through which a seal oil pressurized to a level slightly higher than the pressure of the thrust balance line 9 is supplied to seal rings 13a and 13b. Numerals 14a and 14b denote drainers for separating the mixed gas and the seal oil from each other, while numerals 15a and 15b denote orifices connected to these drainers. An oil reservoir is designated at a reference numeral 16.

Figure 3:
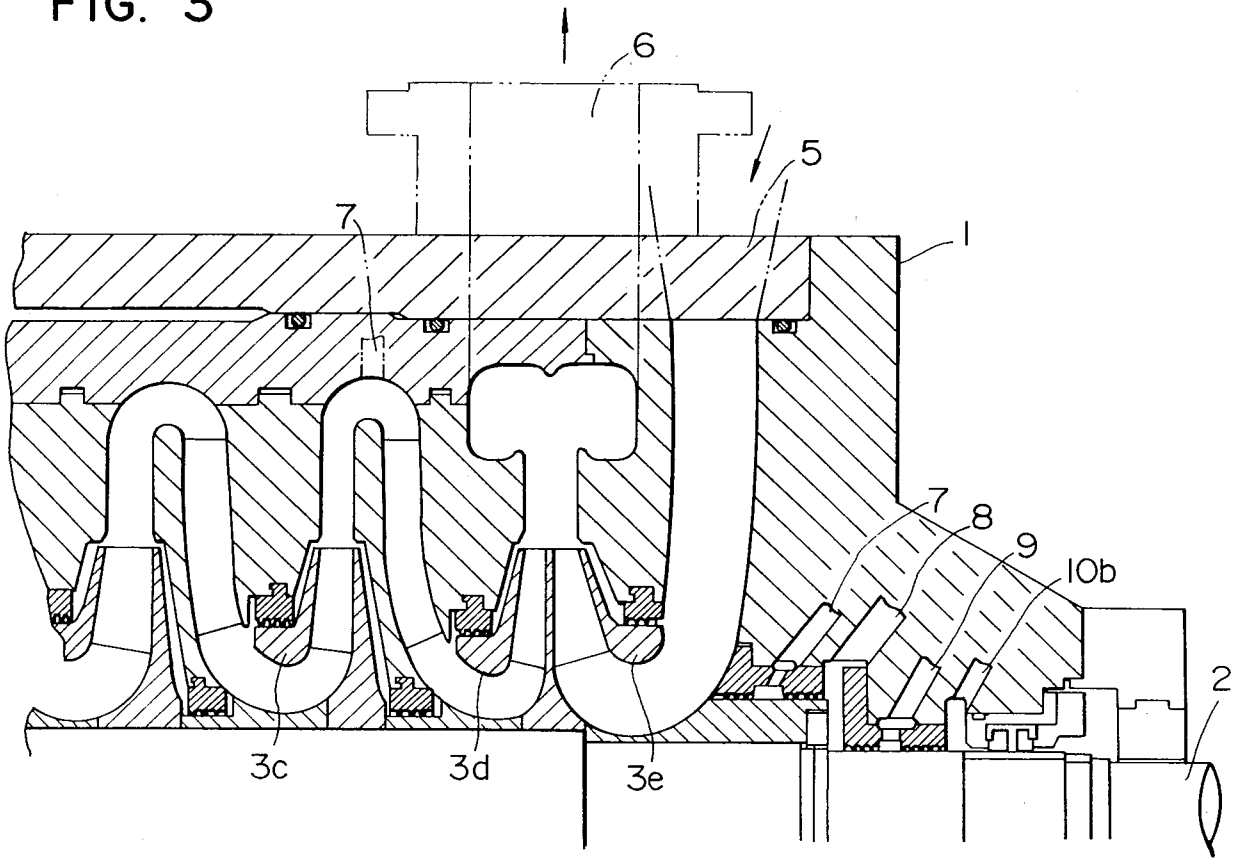
FIG. 3 is a sectional view showing the internal structure of the compressor shown in FIG. 2.
Figure 4:
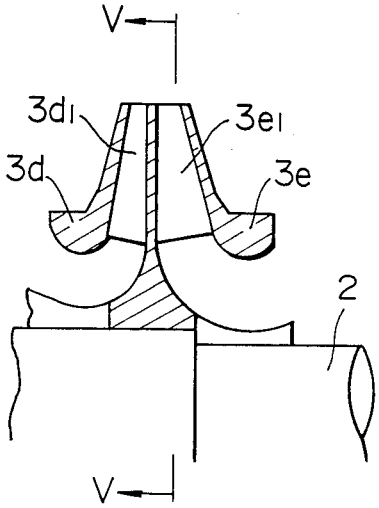
FIG. 4 is a schematic view for illustrating the impeller incorporated in the compressor of the present invention.
Figure 5:
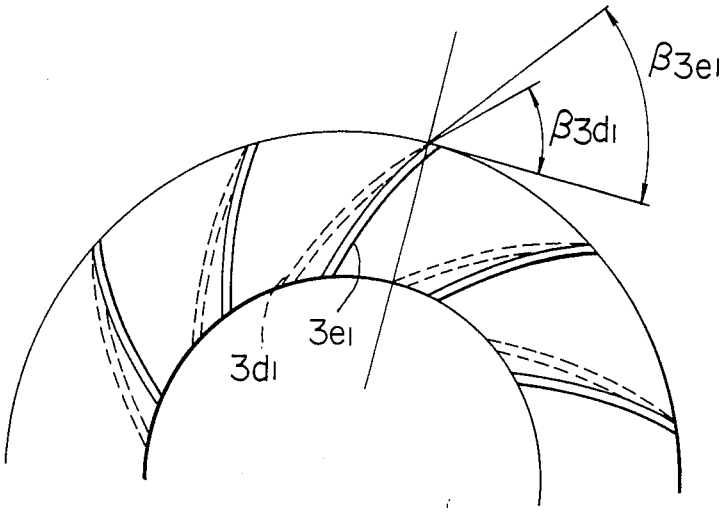
FIG. 5 is a sectional view taken along the line V—V of FIG. 4.

FIGS. 3 to 5 in combination show the internal structure of the compressor shown in FIGS. 1 and 2. Referring to these Figures, the impeller 3d of the final stage for compressing the main gas and the impeller 3e for compressing the intermediate suction gas are arranged in a back-to-back relation. The compressor is designed and constructed such that the suction pressure of the impeller 3d of the final stage for compression of main gas is always higher than the suction pressure of the impeller 3e. That is, the amount of work or head given by the impeller 3d to the main gas flowing from the suction side to the delivery side of this impeller 3d is always smaller than that given by the impeller 3e to the intermediate suction gas.

A practical example of the arrangement for realizing such a condition as described above is shown 15 in FIG. 5. In the example, the exit angle $\beta 3d_1$ of each blade $3d_1$ of the impeller 3d is selected to be smaller than the exit angle $\beta 3e_1$ of each blade $3e_1$ of the impeller 3e. In this case, it is assumed that the impellers 3d and 3e discharge the gases to a common space substantially at the same discharge pressure and that the gas flowing through both impellers 3d and 3e are almost of the same kind.

As an alternative, the diameter of the impeller 3d may be selected to be smaller than the diameter of the impeller 3e, so as to increase the dimension-less flow-rate coefficient of the impeller 3d.

The compressor of the described embodiment operates in a manner which will be explained hereinunder.

The main gas which is drawn through the main gas suction port 4 is progressively compressed through the impellers 3a, 3b, 3c and 3d of the respective stages, and is discharged through the discharge port 6 after being mixed with the intermediate suction gas which has been introduced through the intermediate gas suction port 5 and compressed through the impeller 3e. At this time, the pressure of the main gas discharged into the space in the discharge port 6 and the pressure of the intermediate suction gas discharged into the space in this port 6 are maintained substantially at the same level, e.g., about 150 kg/cm$^2$. On the other hand, the suction pressure of the impeller 3d of the final stage for the compression of the main gas is higher than the suction pressure of the impeller 3e. Thus, the discharge pressure of the third-stage impeller 3c immediately upstream of the impeller 3d of the final stage is maintained at a level, e.g., 140 kg/cm$^2$, which is higher than the suction pressure, e.g., 135 kg/cm$^2$, of the intermediate suction gas. A part of the main gas before mixing with the intermediate suction gas, available at the discharge side of the impeller 3c, is supplied to an intermediate portion of the thrust balance piston 11 constituting a shaft seal, through the seal gas supply line 7. Since this portion of the main gas has a pressure higher than the pressure of the intermediate suction gas, a part of the gas flows along the compressor as indicated by an arrow A, while another part flows through the balance labyrinth as indicated by an arrow B and further returned to the main gas suction port 4 through the thrust balance line 8. The remainder part of the gas which has passed through the shaft seal portion is intorduced into the drainer 14b.

As has been described, in the compressor of the present invention, it is possible to supply a part of the clean main gas to the shaft seals and drainers, without requiring supply of a buffer gas and an intermediate suction gas, so that the shaft seals and the drainers are protected from corrosive and toxic components which may be contained by the intermediate suction gas. It is, therefore, possible to improve the durability of the such parts of the compressor. Additionally, since the necessity for the provision of a separate supply source for a buffer gas is eliminated, the production cost can be decreased remarkably. Needless to say, the improved durability offers a higher reliability of the compressor.

FIGS. 6 to 9 in combination show another embodiment of the present invention in which the same reference numerals denote the same parts or members as those used in the compressor shown in FIGS. 1 to 5.

In the compressor of this embodiment, the main gas is drawn through the main gas suction port 4 and is compressed by the main gas compression impeller 3a. The thus compressed main gas is mixed with the intermediate suction gas drawn through the intermediate gas suction port 5. The mixture is then compressed by an impeller 3f and is discharged through the discharge port 6. A main gas extraction device 17 is provided in a portion of the main gas line immediately upstream of the region where the main gas is mixed with the intermediate suction gas, between the impeller 3d of the final stage for the compression of the main gas and the impeller 3f for compressing the mixture. The main gas extraction device 17 is connected through the seal gas supply line 7 to a gas chamber 20 provided in the discharge-side end of the compressor. The gas chamber 20 constitutes a seal (buffer) gas chamber. Another gas chamber 21 is formed on the axially inner side of the seal gas chamber 20 and is separated from the latter by a labyrinth. The gas chamber 21 and the intermediate suction gas line is connected to each other through a balance line 18. Similarly, still another gas chamber 22 is provided on the axially outer side of the gas chamber 20 and is separated from the gas chamber 20 by a labyrinth. This gas chamber 22 is connected to the main gas suction line through the thrust balance line 8. A further gas chamber 23b provided on the axially outer side of the gas chamber 22 is connected to a gas chamber 23a formed on the opposite axial end of the compressor, through the thrust balance line 9. Further gas chambers 24a and 24b, which are provided on the axially outer sides of the gas chambers 23a and 23b, respectively, are connected to each other through a reference line 19. Seal rings 13a and 13b are provided on the axially outer sides of the reference gas chambers 24a and 24b. Sealing oil which is pressurized to a level slightly greater than the pressure in the reference line 19 is supplied to these rings 13a, 13b thereby preventing oil supplied to the seal rings 13a, 13b from leaking to the outside of the compressor. In order to prevent any oil content leaked through the seal rings 13a, 13b from coming into the compressor, the oil-gas mixture formed in the reference gas chambers 24a and 24b is introduced into the drainers 14a and 14b.

A detailed description will be made hereinunder as to the main gas extraction device, with specific reference to FIG. 7. The main gas extraction device has a main gas extraction tube 29 which penetrates an outer casing 25 and an inner casing 26 so as to extend substantially at a right angle to the flow of the gas, at a portion of the main gas passage upstream of the region where the main gas 27 and the intermediate gas 28 are mixed with each other. The main gas extraction tube 29 is provided at its inner end with an extraction port 30 which is directed substantially orthogonally to the axis of the extraction tube 29. Thus, the extraction tube 29 is capable of extracting whole pressure of the flow of the main gas. The extraction tube 29 is secured by bolts to a flange 31 so that the orientation of the extraction port 30 can be changed as desired. A lock nut 32 is provided for the purpose of preventing any unintentional rotation of the tube 29. The operation of this embodiment will be described hereinunder with reference to the drawings.

Figure 7:
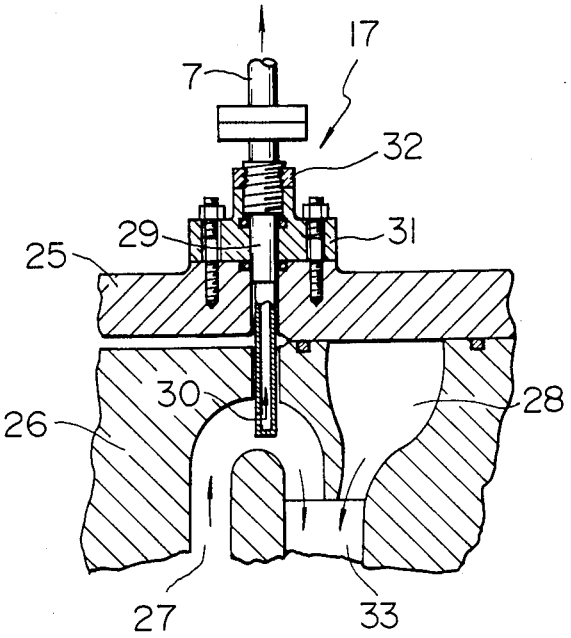
FIG. 7 is a detailed illustration of a main gas extraction device used in the compressor of the present invention.

With the arrangement shown in FIG. 7, the gas extraction device can provide a seal gas of a pressure which is equal to the total pressure given by the following formula (1):

$$P_0 = P_s + \gamma v^2/2g \quad (1)$$

where, $P_0$ represents the total pressure, $P_s$ represents the static pressure, $\gamma$ represents the specific gravity and v represents the flow velocity.

For the purpose of simplification of explanation, neglecting energy loss caused during mixing of the main gas and the intermediate suction gas, the pressure of the intermediate suction gas is regarded as being substantially the same as the static pressure $P_s$ of the main gas. On the other hand, since the main gas extraction tube 29 is inserted into the flow of the main gas such that the extraction port 30 is directed towards the upstream side, it is possible to pickup the dynamic pressure expressed by the second term of the right side of the formula (1) into the seal gas supply line 7. Consequently, a pressure equal to the total pressure $P_0$ is established in the seal gas supply line 7. That is, the pressure of the seal gas extracted from the main gas line can be maintained higher than the intermediate suction gas pressure. A reference numeral 33 designates a return vane.

Figure 6:
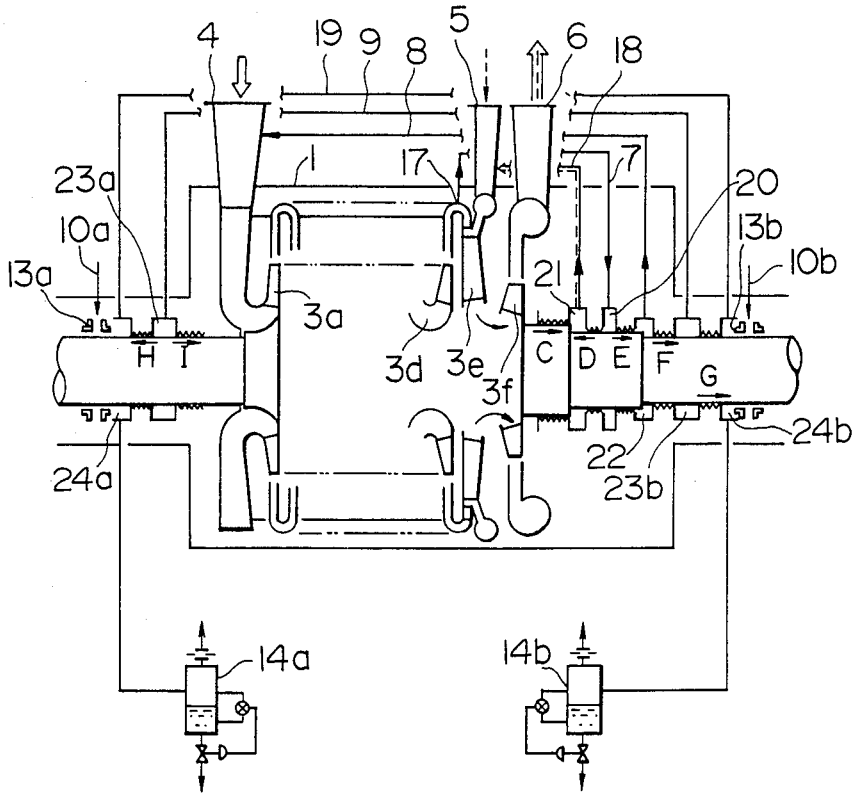
FIG. 6 is a detailed illustration of another embodiment of the present invention.

External flows of gases of this centrifugal compressor will be explained hereinunder with reference to FIG. 6. The mixture of the compressed main gas and the intermediate suction gas is made to flow outward as indicated by an arrow C through the labyrinth of the discharge side, and comes into the gas chamber 21. As this gas chamber 21 is connected to the intermediate gas suction port 5, the mixture introduced into the gas chamber 21 is returned to the intermediate gas suction port 5. The seal gas chamber 20 connected to the main gas extraction portion is provided on the axially outer side of the gas chamber 21. Since the pressure in the seal gas chamber 20 is higher than the intermediate suction gas pressure, a flow of main gas is generated from the seal gas chamber 20 towards the axially inner gas chamber 21 as indicated by an arrow D. Furthermore, since the gas chamber 22 on the outer side of the seal gas chamber 20 is connected to the main gas suction port 4, the gas is made to flow from the seal gas chamber 20 towards the gas chamber 22 as indicated by an arrow E. The gas flow E is constituted solely by the main gas which is introduced from a region immediately upstream of the main gas extraction device 17. Similarly, outward flows of the gas are formed at both axial ends of the compressor through respective labyrinths as indicated by arrows F, G, H and I. It is to be noted that these flows of gas does not contain any fraction of the intermediate suction gas.

It is, therefore, possible to prevent contaminated intermediate suction gas from being supplied to the shaft seal portions and the drainers, whereby the shaft seals and the drainers are kept away from the corrosive components of the intermediate suction gas.

Figure 8:
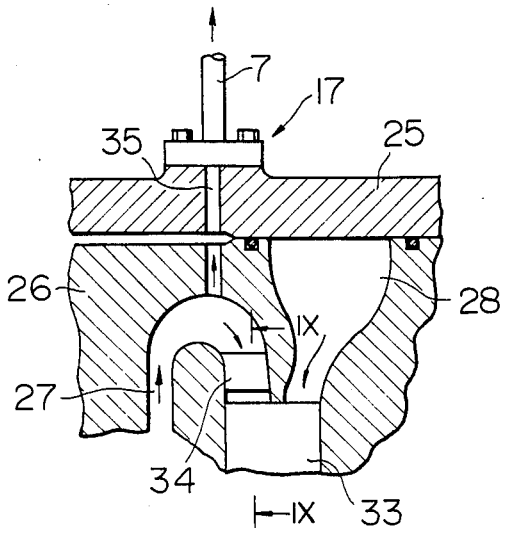
FIG. 8 is a detailed illustration of another example of the main gas extraction device used in the compressor of the invention.
Figure 9:
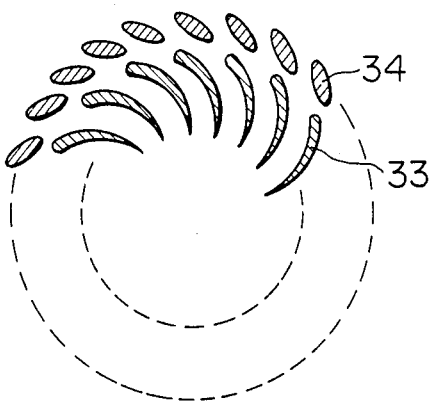
FIG. 9 is a sectional view taken along the line IX—IX of FIG. 8.

FIG. 8 shows another example of the main gas extraction device which produces substantially the same effect as the main gas extraction device explained before. In this case, a plurality of restriction vanes 34 are arranged at an equal circumferential pitch as shown in FIG. 8, within the passage for the main gas upstream from the region where the main gas 27 and the intermediate suction gas 28 are mixed with each other. The restriction vanes 34 are so designed that they restrict the flow of the main gas to such an extent that the static pressure of the gas upstream of the restriction vanes 34 are maintained higher than the intermediate suction pressure. In other words, the pressure drop along the flow path from the restriction vanes down to the region where the main gas is mixed with the intermediate suction gas is increased so as to correspondingly increase the static pressure of the main gas. It is thus possible to extract the seal gas (main gas) from an extraction port 35.

According to the invention, the suction pressure of the impeller constituting the final stage for the compression of the main gas is always maintained at a level higher than the suction pressure of the impeller for compressing the intermediate suction gas, so as to enable a part of the main gas to be supplied to the shaft seals. Consequently, shaft seals and the drainers can stand a longer use, which in turn improves the reliability of the compressor as a whole. This remarkable effect is produced without incurring any increase in the costs, because there is no need for the provision of a separate pressure source such as a source for supplying a pressurized buffer gas.

What is claimed is:

1. A single-shaft multi-stage centrifugal compressor for compressing and discharging a mixture of a main gas and an intermediate suction gas, comprising: a casing; an impeller shaft rotatably mounted in the casing; a multiplicity of impellers carried by the impeller shaft; and shaft seals on both axial ends of the impeller shaft, wherein an impeller constituting a final stage for compression of the main gas and an impeller for compressing the intermediate suction gas are arranged in a back-to-back relation, said casing defining a common outlet for both the final stage impeller and the intermediate suction gas impeller, a suction pressure of the impeller constituting the final stage is maintained at a level higher than a suction pressure for an intermediate gas suction line, and a gas supply line for introducing a sealing gas to the shaft seals from a region of the compressor where a pressure of a main gas line is higher than the suction pressure of the intermediate suction gas line.

2. A single-shaft multi-stage centrifugal compressor according to claim 1, wherein an exit angle of each blade of the impeller constituting the final stage for the compression of the main gas is formed to be smaller than that of the impeller for compressing the intermediate suction gas.

3. A single-shaft multi-stage centrifugal compressor according to claim 1 or 2, wherein an outside diameter of said impeller constituting the final stage for the compression of the main gas is greater than an outside diameter of said impeller for compressing the intermediate suction gas.

4. A single-shaft multi-stage centrifugal compressor for compressing and discharging a mixture of a main gas and an intermediate suction gas, said compressor having a casing, an impeller shaft rotatably mounted in the casing, a multiplicity of impellers carried by the impeller shaft, and shaft seals on both axial ends of the impeller shaft, wherein a main gas extraction device is provided in a portion of a stationary-side gas passage between an impeller for compressing said intermediate suction gas and an adjacent impeller for compressing said main gas said casing defining a common outlet for both the final stage impeller and the intermediate suction gas impeller, a gas pressure of said main gas immediately upstream of said portion of said gas passage being higher than the suction pressure of the intermediate suction pressure, and a gas supply line is provided for supplying a part of said main gas extracted by said main gas extraction device to said shaft seals.

5. A single-shaft multi-stage centrifugal compressor according to claim 4, wherein said main gas extraction device has a main gas extraction tube which is disposed in a flow of said main gas perpendicularly thereto and provided at its end with a main gas extraction port, and said main gas extraction tube is mounted such that orientation of said main gas extraction port can be changed as desired.

6. A single-shaft multi-stage centrifugal compressor according to claim 4, wherein said main gas extraction device includes a plurality of restriction vanes arranged at an equal circumferential pitch.

* * * * *